US008899836B2

(12) United States Patent
Wedi et al.

(10) Patent No.: US 8,899,836 B2
(45) Date of Patent: Dec. 2, 2014

(54) SIDE GUSSETED BAG

(75) Inventors: Johannes Wedi, Emsdetten (DE); Rudolf Haimerl, Konzell (DE); Peter Strübbe, Lengerich (DE)

(73) Assignee: Bischof + Klein GmbH & Co. KG, Lengerich (DE)

( * ) Notice: Subject to any disclaimer, the term of this patent is extended or adjusted under 35 U.S.C. 154(b) by 410 days.

(21) Appl. No.: 12/999,645

(22) PCT Filed: Jun. 9, 2009

(86) PCT No.: PCT/EP2009/004148
§ 371 (c)(1),
(2), (4) Date: Dec. 17, 2010

(87) PCT Pub. No.: WO2010/003500
PCT Pub. Date: Jan. 14, 2010

(65) Prior Publication Data

US 2011/0091140 A1 Apr. 21, 2011

(30) Foreign Application Priority Data

Jun. 17, 2008 (DE) ..... 20 2008 008 134 U

(51) Int. Cl.

| | |
|---|---|
| ***B65D 30/20*** | (2006.01) |
| ***B65D 33/00*** | (2006.01) |
| ***B65D 33/16*** | (2006.01) |
| ***B65D 75/58*** | (2006.01) |
| ***B65D 33/24*** | (2006.01) |
| ***B65D 33/25*** | (2006.01) |
| ***B65D 33/18*** | (2006.01) |

(52) U.S. Cl.
CPC ..... *B65D 31/10* (2013.01); *B65D 75/5866* (2013.01); *B65D 33/24* (2013.01); *B65D 33/2591* (2013.01); *B65D 33/18* (2013.01)
USPC ..... 383/120; 383/210.1; 383/211; 383/64

(58) Field of Classification Search
CPC ..... B65D 33/2591; B65D 31/10; B65D 75/5866; B31B 19/90; B31B 2219/9019
USPC ..... 383/120, 63, 64, 61.2, 210–211
See application file for complete search history.

(56) References Cited

U.S. PATENT DOCUMENTS 5,941,643 A * 8/1999 Linkiewicz ..... 383/210
6,030,123 A * 2/2000 Mitarai ..... 383/63

(Continued)

FOREIGN PATENT DOCUMENTS

| | | | |
|---|---|---|---|
| DE | 20218099 | U1 | 2/2003 |
| EP | 1 442 992 | A | 8/2004 |
| WO | 2004026704 | A | 4/2004 |

*Primary Examiner* — Jes F Pascua
(74) *Attorney, Agent, or Firm* — Gudrun E. Huckett

(57) ABSTRACT

The invention relates to a side gusseted bag 1,21 made of flexible material, wherein two opposing main walls 2,23 are connected at adjacent long sides 5,6 by at least one (first) side gusseted wall 4,22 that can be folded between the main walls 2,23 and comprise an opening at the top side that can be connected to a resealable closure 7,24 made of at least a pair of opposing closure elements 8,26 mounted on one or the other of the main walls 2,23, wherein the closure elements 7,24 are not fixed to each other at the ends thereof above the side gusseted wall in the opened state of the closure element, and the side gusseted wall 4,22 can be unfolded outward at the top side, designed in the sense of a good storage and transport closure, simultaneously retaining the potential for simple and wide opening and sufficient closure, such that the side gusseted wall 4,22 is separably fixed in a folded position between the main walls 2,23 before it is first opened.

11 Claims, 2 Drawing Sheets

(56) References Cited

U.S. PATENT DOCUMENTS

| | | | | |
|---|---|---|---|---|
| 6,164,826 | A | 12/2000 | Petkovsek | |
| 6,186,663 | B1 * | 2/2001 | Ausnit | 383/63 |
| 6,398,412 | B2 * | 6/2002 | Wedi et al. | 383/211 |
| 6,805,485 | B2 * | 10/2004 | Hogan et al. | 383/64 |
| 6,971,794 | B2 * | 12/2005 | Yeager | 383/61.2 |
| 7,144,159 | B2 * | 12/2006 | Piotrowski et al. | 383/64 |
| 7,204,641 | B2 * | 4/2007 | Stolmeier | 383/64 |
| 8,142,077 | B2 * | 3/2012 | Iannelli et al. | 383/64 |
| 2001/0017947 | A1 * | 8/2001 | Strand et al. | 383/61 |
| 2004/0101215 | A1 * | 5/2004 | Sellmeier et al. | 383/113 |
| 2004/0131284 | A1 * | 7/2004 | Stolmeier | 383/64 |
| 2004/0146224 | A1 * | 7/2004 | Piotrowski et al. | 383/64 |
| 2004/0184680 | A1 * | 9/2004 | DeMatteis et al. | 383/44 |
| 2007/0133908 | A1 * | 6/2007 | Bruns | 383/95 |
| 2008/0008406 | A1 | 1/2008 | Russell | |
| 2008/0240629 | A1 * | 10/2008 | Biller et al. | 383/211 |

* cited by examiner

SIDE GUSSETED BAG

BACKGROUND OF THE INVENTION

The invention concerns a side gusseted bag according to the preamble of claim 1. Side gusseted bags are used widely in particular because they enable a usually desired parallelepipedal shape with a rectangular or square cross-section and with suitable top and bottom shapes. However, with respect to openings that are to be provided at the top area with folded-in side gussets the design of the side gusseted bag is often unsatisfactory. This applies in particular in case of resealable bags where only an opening of a slit shape extending approximately across the width of the main surfaces may be realized into which then possibly the upper ends of the side gusseted walls project obstructively. Primarily in case of bag contents that are not easily flowable or pourable and that optionally require for removal of the bag contents a shaking or grabbing action, the opening of the bag is unsatisfactory with respect to accessibility and handling.

EP 1 442 992 A discloses a side gusseted bag with a resealable closure that has a side gusset that can be folded freely outwardly and thus has a large, easily accessible opening. In order to close the bag, to secure the side gusset during transport, and also in order to provide a tamper evident closure, the side gusseted bag can be closed at a spacing below the resealable closure with a horizontal tear seam extending across the side gusset and the front and back sides. This however results in a difficult opening action requiring tearing open the seam across the entire width and a loss of usable packaging height.

SUMMARY OF THE INVENTION

It is therefore the object of the invention to provide a side gusseted bag that can be easily accessed, that is sealable or at least coverable against spilling or soiling of the contents with a resealable closure after a first opening action, and that can be produced by manufacturing technologies for side gusseted bags produced of flexible material such as plastic film, composite film with metal layers or with paper layers, or even of paper material in a conventional and reliable way and that during transport and storage can be seal-tightly and securely closed but can be easily opened when in use.

According to the invention, this object is solved by a side gusseted bag of flexible material, in which two main walls positioned opposite each other are connected at neighboring longitudinal sides by at least one (first) side gusseted wall that can be folded inwardly between the main walls and at the top has an opening that is to be closed by a resealable closure of at least one pair of oppositely positioned closure elements that are connected to one or the other main wall, wherein the closure elements in the open state of the closure element at the end above the side gusseted wall are not secured to each other, and the side gusseted wall at the topside can be folded outwardly, characterized in that the side gusseted wall before a first opening action is secured in a folded position between the main walls in a tear-apart way. In this way, the advantage is maintained that the opening provided with a resealable closure can be expanded in that the main walls and the closure elements connected thereto at least on one side are freely movable away from each other and that the side gusseted wall that is folded in on this side can be spread apart and therefore provide a correspondingly wide opening or, in case of the side gusseted wall being folded outwardly, enables enlarging the opening past the width of the main walls. The larger and also smooth-surfaced dispensing or removal opening that is obtained in this way is usually advantageous with regard to handling even when the contents of the side gusseted bag is flowable. Conventional side gusseted bags cannot be easily and simply emptied even for folded-in side gusseted walls or side gusseted walls that are projecting into the opening. The outwardly foldable side gusseted wall, in contrast to this, provides an enlarged opening and smooth surfaces for dispensing. The enlarged removal opening becomes even more important in case of contents of individual pieces that can be difficult to dispense or must be removed by hand or with auxiliary means. They can be much more comfortably removed from the side gusseted bag according to the invention.

With the embodiment that the side gusseted wall before a first opening action is secured in a tear-apart way in a folded position between the main walls, the side gusseted wall is initially secured during transport and storage against folding outwardly and also dosed such that the contents of the bag will not escape to the exterior nor will become soiled from the exterior. The tear-apart possibility enables however upon first use in a simple and expedient way to open the bag and to enable the outward folding of the side gussets.

A removal opening that is open (only) to one side with an outwardly foldable side wall is to be provided in many cases based on the shape of the resealable closure even when the side gusseted bag in the conventional shape has two side gusseted walls that are positioned opposite one another between the main walls. Resealable closures of complementarily shaped plastic profiled strips as they are to be locked with each other by hand without a slide as so-called "zipper" closures as well as resealable closures with such profiled strips that are to be opened and closed by a slide movable in longitudinal direction like a slide fastener are expediently or necessarily connected at one end. Accordingly, closure elements comprised of profiled strips are to be embodied so as to be disconnected only at one end for a complete opening action. On the other end, the profiled closure elements remain engaged with each other and are held together by hot shaping, sealing or fusing of the closure elements themselves or of neighboring wall areas. Closure elements with a slide in open position are secured already by the slide in engaged position. Usually, by deformation of the closure elements, pushed-on clips, or the like a stop for the slide is provided so that it cannot be pushed accidentally past the end of the closure elements and cannot become disengaged.

The afore described observations however do not in principle preclude that also a second side gusseted wall can be designed to be foldable outwardly and that the resealable closure opens completely. In this respect, a "zipper" closure with complementary profiled closure elements can be separated as a whole. The same applies in particular also to resealable closures in the form of a hook-and-loop fastener or with detachable and reconnectable adhesive strips.

As a solution of the object generally however a one-sided folding out of the side gusseted wall is sufficient and a fixation of the resealable closure on the other end is advantageous with regard to handling considerations so that this is the preferred embodiment.

The outwardly foldable side gusseted wall in many cases can also be loosely folded in at the topside before the first opening of the side gusseted bag, for example, when no special sealing requirements exist in case of bag contents of dry individual pieces. In other cases, the side gussets of the unopened bag can be secured such that tearing apart is possible. This may be recommended also in case of contents of dry individual pieces in order to seal against soiling from the exterior or to relieve the resealable closure that otherwise, in case of high degree of filling of the side gusseted bag, is at risk of opening during handling and transport. Outward folding at the topside of the side gusseted wall can also be a reason for fixation of the side gusset.

Such a fixation can be realized by gluing or fusing between the side wall parts that are resting on each other. Alternatively or additionally, the side wall parts may also be glued or sealed with one or with both of the main walls.

In this connection, however, detachability of the connection is to be provided. With a permanent-elastic adhesive or by a seal that is modified in the sense of detachability a simple first opening may be enabled. For example, with respect to manufacturing considerations with a two-sided "peelable" adhesive strip a detachable but optionally also restorable connection can be generated. In case of a connection with the aid of a sealing seam, the seam areas can be designed for easy detachability to be more easily tearable relative to the otherwise fixed sealing seams by means of a release lacquer that is applied only partially on the surface, for example, in grid shape. A weakened sealing connection can also be obtained with the aid of a laser pretreatment. A person skilled in the art has thus the possibility by means of proven measures to provide a detachable fixation of the side gusseted wall that imparts to the side gusseted bag, at least before the first opening action, strength and optionally also seal-tightness.

BRIEF DESCRIPTION OF THE DRAWINGS

Two embodiments of the invention are illustrated in the drawing and will be explained in the following in more detail. In the drawings, it is shown in.

DESCRIPTION OF PREFERRED EMBODIMENTS

Figure 1:
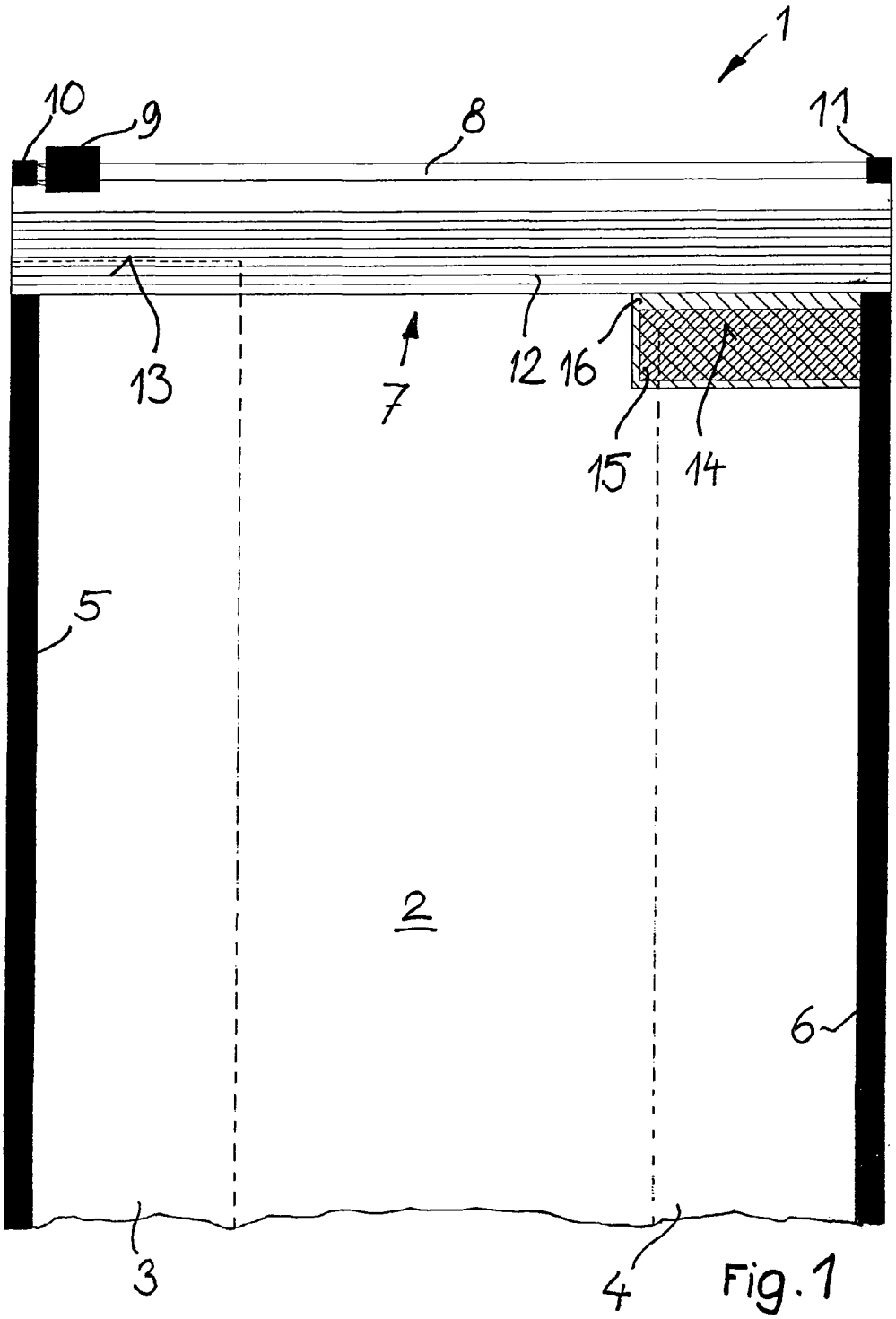
FIG. 1 a side gusseted bag according to the invention, laid flat, in a view from the front.

A side gusseted bag, referenced in FIG. 1 as a whole by 1 and shown in a front view but in a partial view without the bottom area which presently is of no interest and is to be embodied as is conventional, shows a front side main wall 2 that hides a rear main wall positioned congruently behind it as well as two side gusseted walls 3 and 4 that in the laid-flat state are folded inwardly. The side gusseted walls are each connected at both sides by longitudinal sealing seams 5 and 6 (and longitudinal sealing seams congruently positioned therebehind) to the main walls. In principle, the main walls and the side gusseted walls can also be manufactured with outwardly positioned folds.

At the top the side gusseted bag 1 is closed by a resealable closure 7 that can be opened and closed in order to enable later on partial removal from and intermediate storage of the initially still to be filled bag. The resealable closure 7 comprises two closure elements of which a closure element 8 positioned at the upper side covers a closure element provided with a complementary locking profile positioned underneath. Both can be opened and closed by means of a slide 9 wherein the slide 9 in FIG. 1 is shown in an open position near a clamping element 10 that connects the two closure elements 8 with each other and at the same time represents a stop for the movement of the slide 9. In this position of the slide the two closure elements 8 are not connected with each other. An oppositely positioned stop element 11 is connected also only with one of the closure elements 8, respectively.

Each of the two closure elements 8 is has a connecting web 12 for a sealing seam that is to be produced with one or the other main wall 2 so that each one of the closure elements 8 forms a continuation of one of the two main walls in the upward direction. The side gusseted wall 3 projects with an upper terminal edge 13 into the area of the connecting web 12 and is sealed therewith. In this way, the side gusset is provided at the topside with a fixation in a flat folded shape that at the same time leads to seal-tightness. This positionally fixed side gusset 3 is facing the stop 10 for the opening position of the slide 9.

On the side of the side gusseted bag 1 that is facing away from the stop 10 the side gusseted wall 4 is embodied to be shorter with a terminal edge 14 positioned below the connecting web 12. Therefore, a top-side fixation of the side gusset 4 is missing.

However, two detachable adhesive strips 15, 16 are indicated here which, in order to visually differentiate them, are crosshatched in different directions and are shown differently sized even when in practice they would be congruently designed. These adhesive strips adhere the two halves of the side gusseted wall 4 to one or the other main wall 2 and at the same time form the upper end of the side gusseted wall 4 in the folded state. The adhesive strips 15, 16 serve, as needed, for fixation and/or sealing of the side gusset wherein the fixation serves also during transport or handling of the filled bag for relief of the resealable closure 7 and also prevents an undesirable outward folding of the side gusset in the upper area.

The adhesive strips 15, 16 can also be replaced by a sealing seam that is pre-weakened in a particular way and therefore can be easily torn open. In the simplest case, however, any fixation of the lateral seam in the upper area can be eliminated.

The outwardly foldable (even for detachable fixation) side gusseted wall 4 in combination with the resealable closure elements 8 that upon opening are, completely separable from each other in the area of the stops 11 enables a large opening and thus an excellent accessibility of the bag contents for the first and each further opening action, wherein the side gusseted bag by means of the resealable closure 7 intermediately can be closed, sealed or covered in the prescribed way.

Figure 2:
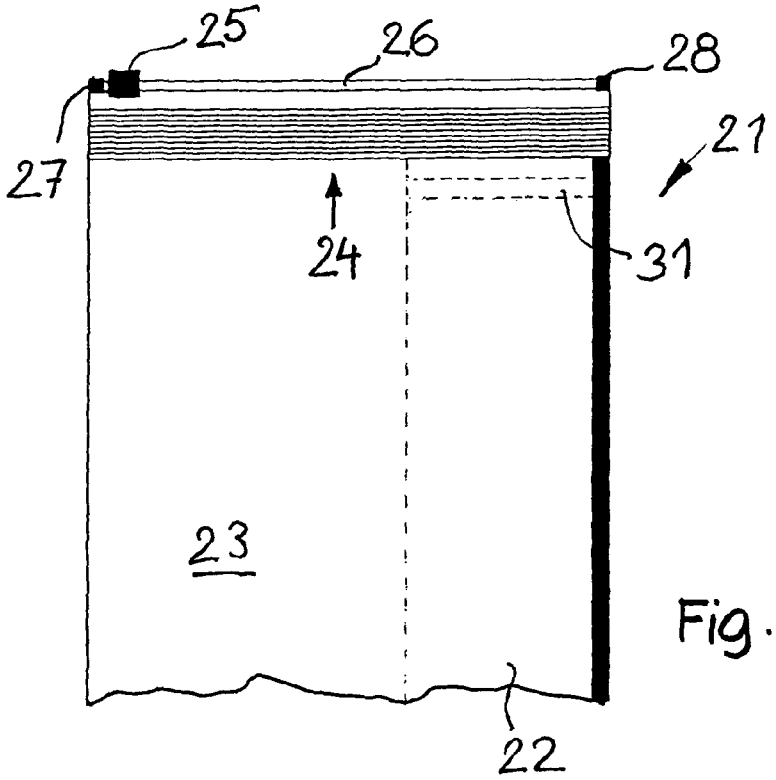
FIG. 2 a modified embodiment of a side gusseted bag, laid flat, in a view from the front.

In FIG. 2, a side gusseted bag 21 is illustrated with a shape that is unconventional in practice with only one side gusseted wall 22 that, as shown in FIG. 2, is folded inwardly between a main wall 23 and a main wall that is congruently positioned therebehind, with which the opening action is particularly easily exemplified. The side gusseted bag 21 is provided with a resealable closure 24 that, as the resealable closure 7, is actuated by means of a slide 25, here shown in the left opening position, wherein the slide 25 in the opening position combines or separates two complementary profiled closure elements 26 and in the left end position still holds together these closure elements. A stop 27 in the form of a clamp engaging across the closure elements 26 secures the connection of the closure elements in the same way. On the opposite end, two stops 28 that are congruently arranged relative to each other are disposed separately on the closure elements so that they therefore do not prevent the closure elements being moved away from each other.

Figure 3:
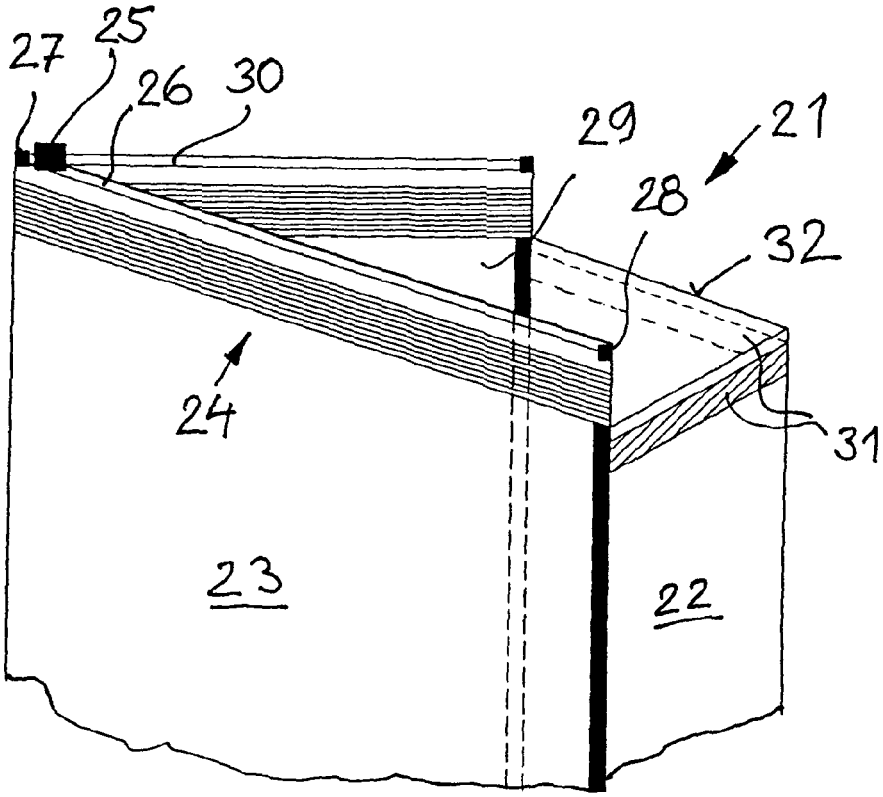
FIG. 3 side gusseted bag according to FIG. 2 in the open state.

As can be seen in the opening position of FIG. 3, the main wall 23 and main wall 29 visible behind it can be spread apart widely together with the closure element 26 and the closure element 30 connected to the main wall 29 wherein the side gusseted wall 22 can even be folded outwardly.

In this embodiment, an adhesive strip 31 is provided along a top edge 32 of the side gusseted wall 22 on the exterior side so that it is able to secure the side gusseted, wall in the folded-in state (optionally also repeatedly). This adhesive strip 31 is also embodied such that it can be easily detached and upon opening of the side gusseted bag will not impair the outward folding action.

What is claimed is:

1. A side gusseted bag of flexible material, the side gusseted bag comprising:

two main walls positioned opposite each other, wherein the two main walls have neighboring longitudinal sides and a top side;

a first side gusseted wall connecting the neighboring longitudinal sides of the two main walls at a first longitudinal end, wherein the side gusseted wall is foldable inwardly between the two main walls into a folded-in state;

wherein the two main walls have an opening at the top side;

a resealable closure comprising a first and a second oppositely positioned closure elements, wherein each one of the closure elements is connected to one of the two main walls at the top side and wherein the resealable closure opens or closes the opening;

wherein, in an open state of the resealable closure, the first and second closure elements are not secured to each other at a first end of the resealable closure which first end is above the first side gusseted wall;

wherein the first side gusseted wall, before first opening the bag, is secured in a folded position between the main walls and is foldable outwardly at the topside after first opening of the bag;

at least one separate adhesive strip, embodied separate from the two main walls and the first side gusseted wall, wherein the at least one separate adhesive strip is attached to an upper end of the first side gusseted wall along a terminal edge of the first side gusseted wall and secures the first side gusseted wall in said folded position, wherein the at least one separate adhesive strip is reused to secure repeatedly the first side gusseted wall in said folded position after the bag has been opened;

wherein the side gusseted wall is detachably secured at least on one of the two main walls by the at least one adhesive strip.

2. The side gusseted bag according to claim 1, wherein the first and second closure elements at a second end opposite the first end of the resealable closure are connected to each other in the open state.

3. The side gusseted bag according to claim 2, wherein the first and second closure elements at the second end of the resealable closure are connected with each other by material fusion.

4. The side gusseted bag according to claim 2, wherein the first and second closure elements are profiled closure elements that are lockable with each other, wherein the resealable closure comprises a longitudinally moveable slide, wherein the profiled closure elements are separated on the side of the slide facing the side gusseted wall and are connected on the side of the slide facing away from the side gusseted wall.

5. The side gusseted bag according to claim 4, wherein the resealable closure comprises a stop for the slide at the second end of the resealable closure remote from the side gusseted wall.

6. The side gusseted bag according to claim 1, wherein the first side gusseted wall, when in said folded position, is secured by two of the at least one adhesive strip to the main walls.

7. The side gusseted bag according to claim 1, wherein the at least one adhesive strip seals the first side gusseted wall at the upper end in said folded position.

8. The side gusseted bag according to claim 1, wherein the first side gusseted wall is embodied to be shorter than the main walls and the terminal edge is positioned below connecting webs of the releasable closure.

9. The side gusseted bag according to claim 8, comprising a second side gusseted wall connecting the neighboring longitudinal side of the two main walls at a second longitudinal end opposite the first side gusseted wall.

10. The side gusseted bag according to claim 9, wherein the second side gusseted wall has a terminal edge extending into an area of one of the connecting webs and sealed with said one connecting web in a folded-in state.

11. The side gusseted bag according to claim 8, wherein the main walls are directly connected to each other at the longitudinal sides at a second longitudinal end that is opposite the first side gusseted wall.

* * * * *